US005817229A

United States Patent [19]

Sudhakar et al.

[11] Patent Number: 5,817,229

[45] Date of Patent: Oct. 6, 1998

[54] CATALYTIC HYDROCARBON UPGRADING PROCESS REQUIRING NO EXTERNAL HYDROGEN SUPPLY

[75] Inventors: Chakka Sudhakar, Fishkill; Regis J. Pellet, Croton-on-Hudson; Mahendra Somabhai Patel, Hopewell Junction, all of N.Y.

[73] Assignee: Texaco Inc, White Plains, N.Y.

[21] Appl. No.: 746,038

[22] Filed: Nov. 6, 1996

Related U.S. Application Data

[60] Provisional application No. 60/007,295 Nov. 6, 1995.

[51] Int. Cl.[6] ..... C10G 29/02

[52] U.S. Cl. ..... 208/299; 208/307; 208/208 R; 208/209; 208/213; 208/254 R; 208/254 H; 208/113; 208/108; 502/174; 502/180

[58] Field of Search ..... 208/307, 208 R, 208/209, 213, 254 R, 254 H, 299, 113, 108; 502/174, 180

[56] References Cited

U.S. PATENT DOCUMENTS

| | | | |
|---|---|---|---|
| 1,884,495 | 11/1932 | Zurcher | 208/307 |
| 2,880,167 | 3/1959 | Kimberlin, Jr. et al. | 208/113 |
| 3,340,316 | 9/1967 | Wackher et al. | 260/674 |
| 3,948,754 | 4/1976 | McCollum et al. | 208/11 LE |
| 4,214,977 | 7/1980 | Ranganathan et al. | 208/108 |
| 4,334,976 | 6/1982 | Yan | 208/8 LE |
| 4,410,421 | 10/1983 | Atherton et al. | 208/254 H |
| 4,743,357 | 5/1988 | Patel et al. | 208/113 |
| 4,994,172 | 2/1991 | Buchanan et al. | 208/106 |
| 5,024,752 | 6/1991 | Yan | 208/131 |
| 5,358,634 | 10/1994 | Rankel | 208/251 H |
| 5,364,524 | 11/1994 | Partridge et al. | 208/251 H |
| 5,374,350 | 12/1994 | Heck et al. | 208/143 |
| 5,472,595 | 12/1995 | Sudhakar et al. | 208/254 H |

*Primary Examiner*—Walter D. Griffin
*Assistant Examiner*—Nadine Preisch
*Attorney, Agent, or Firm*—Henry H. Gibson; Carl G. Ries

[57] ABSTRACT

A hydrocarbon feedstock is brought into contact with activated carbon at a temperature of about 300° to about 650° C. and a pressure of about 0–1000 psig in the absence of added hydrogen to reduce the content of aromatic, sulfur and nitrogen compounds contained therein and to simultaneously lower the specific gravity thereof.

12 Claims, 4 Drawing Sheets

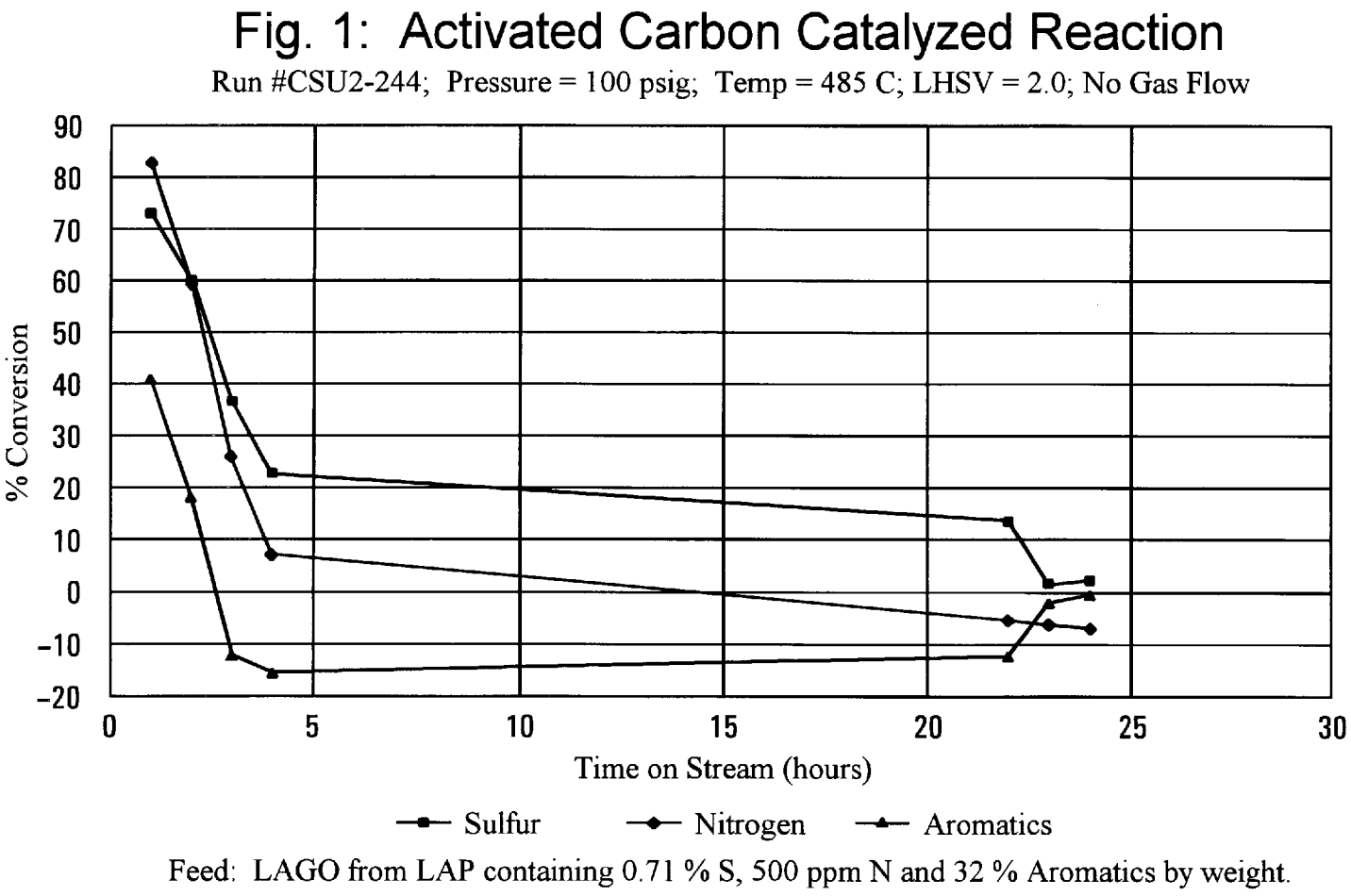
Fig. 1: Activated Carbon Catalyzed Reaction
Run #CSU2-244; Pressure = 100 psig; Temp = 485 C; LHSV = 2.0; No Gas Flow
% Conversion
90
80
70
60
50
40
30
20
10
0
-10
-20
0
5
10
15
20
25
30
Time on Stream (hours)
Sulfur
Nitrogen
Aromatics
Feed: LAGO from LAP containing 0.71 % S, 500 ppm N and 32 % Aromatics by weight.

Fig. 2: Hydrogen Transfer Catalysis: Carbon vs Alpha Alumina
Runs: CSU2-244 vs CSU1-297; Temp. = 485 C, p = 100 psig
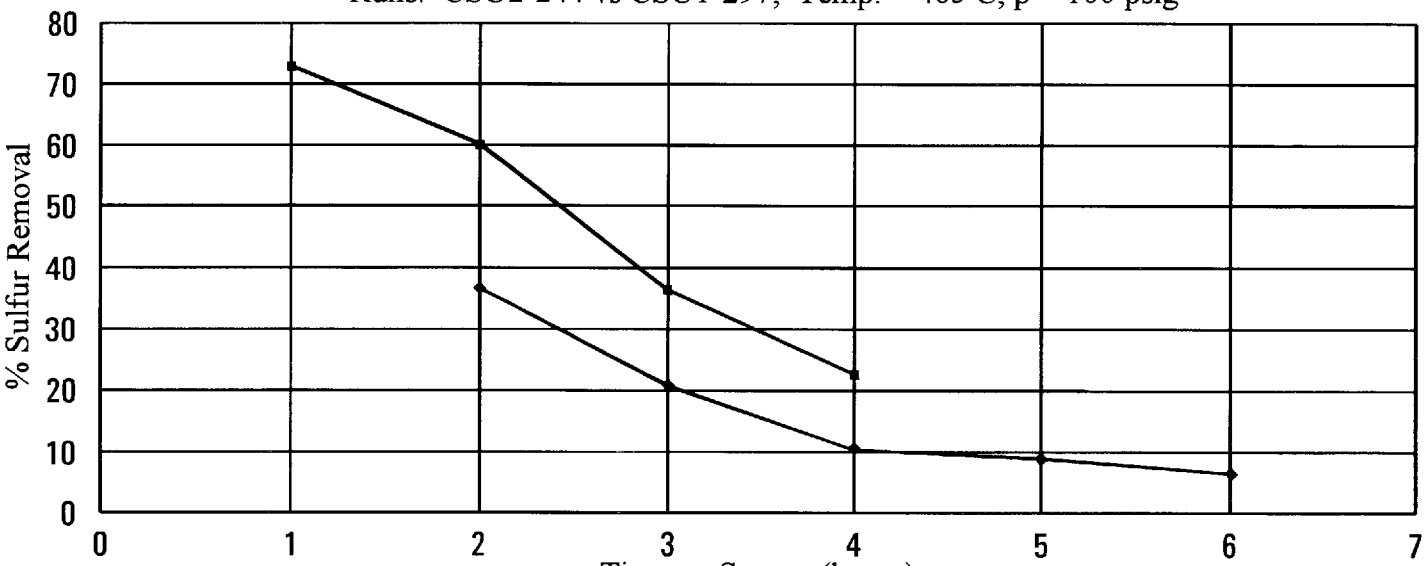
LHSV = 2.0 for Carbon catalyst; LAGO flow rate = 40 cc/hr for alumina run
Feed: LAGO from LAP containing 0.71 % sulfur, 500 ppm nitrogen and 32 % aromatics by weight.

Fig. 3: Hydrogen Transfer Catalysis: Carbon vs Alpha Alumina
Runs: CSU2-244 vs CSU1-297; Temp. = 485 C, p = 100 psig
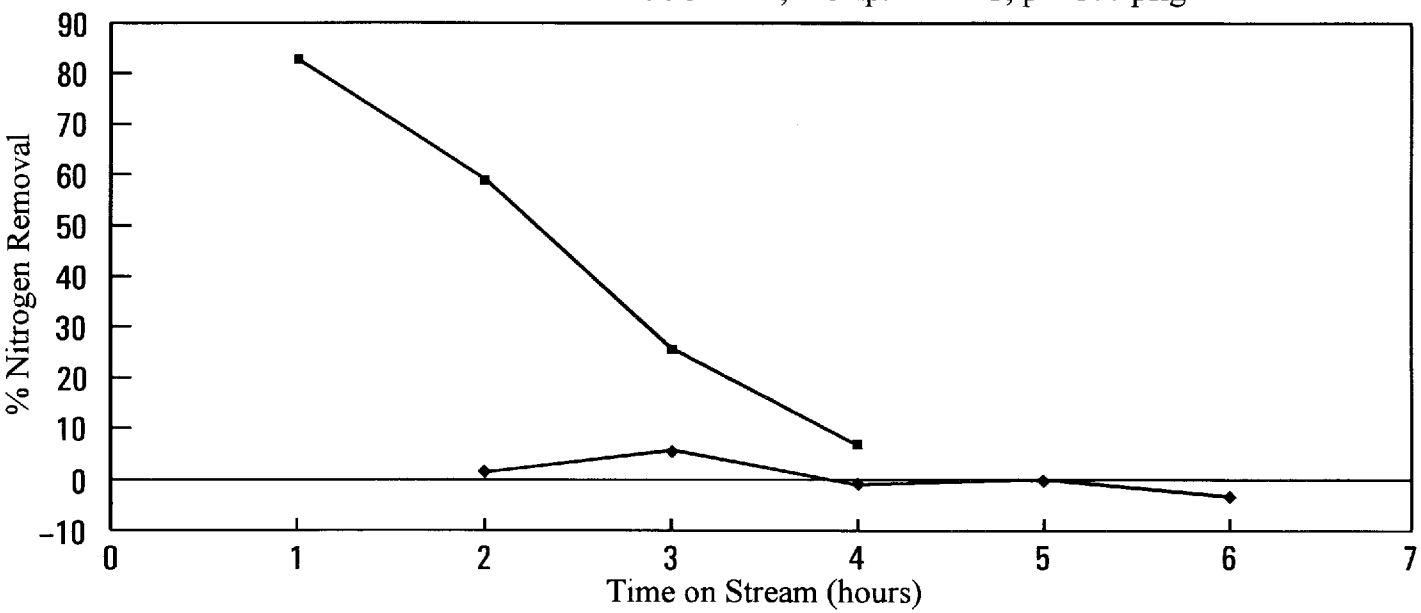
Carbon Catalyst — Alpha Alumnia
LHSV = 2.0 for Carbon catalyst; LAGO flow rate = 40 cc/hr for Alumina run
Feed: LAGO from LAP containing 0.71 % sulfur, 500 ppm nitrogen and 32 % aromatics by weight.

Fig. 4: Hydrogen Transfer Catalysis: Carbon vs Alpha Alumina
Runs: CSU2-244 vs CSU1-297; Temp. = 485 C, p = 100 psig
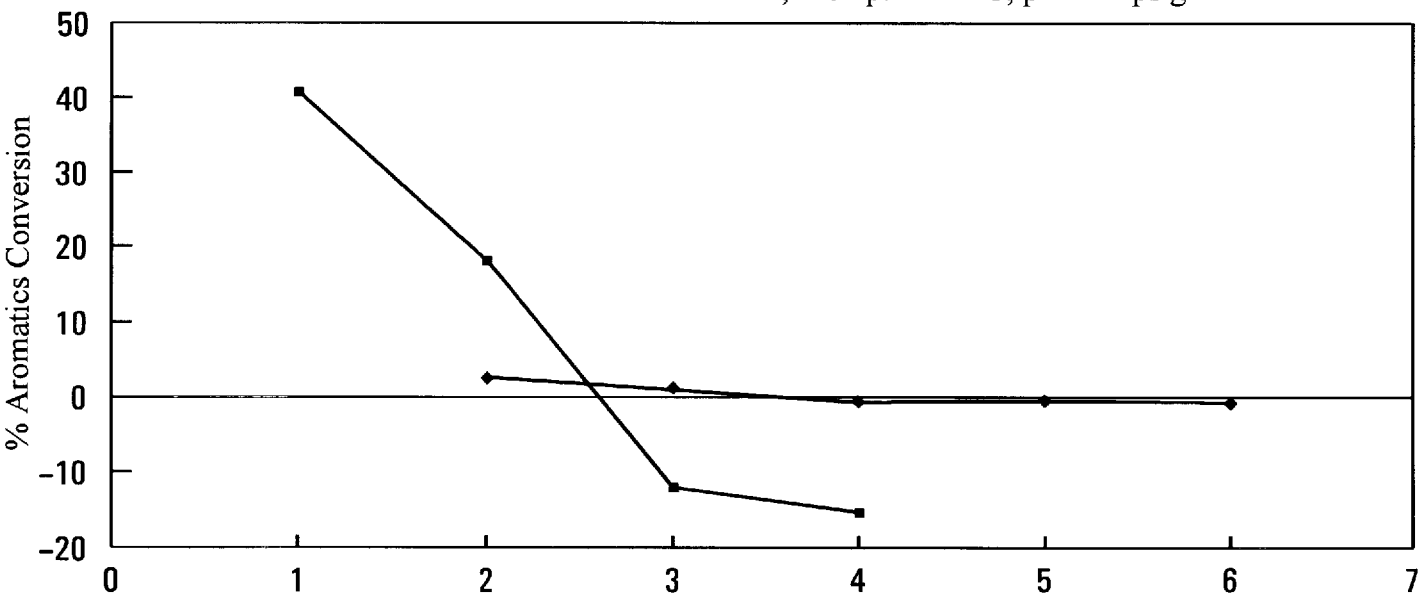
LHSV = 2.0 for Carbon catalyst; LAGO flow rate = 40 cc/hr for Alumina run
Feed: LAGO from LAP containing 0.71 % sulfur, 500 ppm nitrogen and 32 % aromatics by weight.

CATALYTIC HYDROCARBON UPGRADING PROCESS REQUIRING NO EXTERNAL HYDROGEN SUPPLY

CROSS REFERENCE

This application is a continuation-in-part of provisional application no. 60/007,295, filed Nov. 6, 1995.

FIELD OF THE INVENTION

This invention is related to the upgrading of hydrocarbon oils, including those in the range of heavy oils and heavy whole crude oils and residua to those in the lighter range of middle distillates. More particularly it relates to upgrading or hydrocarbons by a process not previously known in the art, in which externally supplied hydrogen is not required. Still more particularly the invention relates to a process for effecting substantial desulfurization, denitrogenation, and aromatics conversion of a variety of types of oil, simultaneously lowering its specific gravity substantially, using an activated carbon catalyst, under generally moderate pressure conditions with no external hydrogen requirement. In the case of heavy oils containing asphaltenes, substantial asphaltene conversion, Conradson carbon conversion and demetallation may also take place in the process. An added feature of the process is that naphthenic acids and other acidic components which plague a number of heavy crudes are converted as well in this process, thus improving the quality and value of the crude oil. The process is particularly suitable to convert heavy high sulfur whole crude oils into lower sulfur synthetic crude oils which can be transported in pipelines for further processing or sale.

BACKGROUND OF THE INVENTION

The need to process heavy crude oils and residua containing large concentrations of sulfur and nitrogen has grown in the last two decades. Environmental considerations require the development of improved catalysts and processes for heteroatom removal and for converting hydrocarbon feedstocks to lower boiling range materials. Sulfur, nitrogen and oxygen removal constitute heteroatom removal processes. Removal of metallic impurities such as vanadium, nickel and iron, if present in the oil, is also very important. Generally, cracking or hydrocracking processes are used for lowering the boiling range of hydrocarbon feeds. The adverse effects of nitrogen compounds on the catalytic activities of the catalysts used in several downstream processes including hydrotreating, hydrocracking, and fluid catalytic cracking are well known to those familiar with the art. In addition to the need for less sulfur and nitrogen, the need for fuels containing lower aromatics concentration has been growing rapidly for environmental consideration.

A number of processes for upgrading heavy oils and crude oils described in the art involve the incorporation or addition of hydrogen into the hydrocarbon feed. In other words, substantial amounts of hydrogen are generally consumed in these processes. Hydrogen is both valuable and expensive, and already a number of refineries are short of hydrogen. Thermal cracking processes such as visbreaking and delayed coking, which do not require hydrogen and which are suitable for upgrading heavy metal laden crude oils suffer from several disadvantages such as instability of the products from these processes, and more importantly substantial loss of valuable hydrocarbon feed as generally worthless coke.

Some references describe processes which incorporate carbon in some manner for use in processes with different objectives. These processes usually require hydrogen.

One process for hydrocracking of heavy oils is described in U.S. Pat. No. 4,214,977. The charge oil forms a slurry with an iron - coal catalyst. This process uses 500–50,000 SCF (standard cubic feet) of hydrogen/barrel of hydrocarbon oil.

In U.S. Pat. No. 4,334,976, there is described a process for heavy hydrocarbon oil conversion which comprises heating an admixture of heavy hydrocarbon oil and particulate coal under visbreaking conditions. The coal is not activated. The heat treatment is conducted at a temperature between about 800° and 950° F., and hydrogen is required.

The process described in U.S. Pat. No. 5,358,634 employs an activated carbon to contact hydrogen with heavy oil to reduce the content of nickel and vanadium. The carbon has an average pore diameter of from 15 Angstroms (Å) to 70 Angstroms and a pore diameter distribution which includes substantially greater pore area and pore volume in the pore diameter range of from 100 Å to about 400 Å. The conditions include a temperature of from 500° F. to about 1200° F. and pressure of 0 psig to 4000 psig.

U.S. Pat. No. 5,364,524 teaches another process for treating heavy oil which comprises contacting the oil with hydrogen in a reactor containing an activated carbon catalyst having a specified range of alpha value, a specified average pore diameter, and pore distribution, to reduce the content of nickel and vanadium.

In U.S. Pat. No. 5,374,350, heavy oil is hydrotreated by processing with hydrogen in the presence of a catalyst composition comprising an activated carbon having a specified pore volume and pore diameter ranges, a molybdenum or tungsten component, and a cobalt or nickel component to reduce the content of nickel and vanadium therein to achieve demetallation.

The only references found in the art which do not use hydrogen pertain to processes for treating heavy oils where the objectives are different from the cases cited above. The reaction conditions are usually different as well. One example is a process for removing metals.

In U.S. Pat. No. 4,743,357 there is disclosed a process for catalytic conversion of heavy hydrocarbons having an API gravity at 25° C. of less than about 20° into lighter hydrocarbons having an API gravity of greater than about 20° and substantially free of vanadium and nickel values.

U.S. Pat. No. 4,994,172 describes an integrated process for producing substantially upgraded syncrude from a heavy crude characterized by an API gravity of less than 20° wherein 10 to 30 wt % of said crude oil is burned to provide thermal energy to produce said heavy crude. The reaction takes place at a temperature of at least 650° F.

In U.S. Pat. No. 5,024,752, there is described a process for upgrading a heavy hydrocarbon feedstock in the liquid phase by treating the feedstock under closely controlled thermal treatment conditions, wherein the product stream comprises two distinct liquid phases. The temperature employed is generally between about 800° and about 1000° F.

None of the processes known in the art appear to address upgrading, and specifically desulfurization, denitrogenation and dearomatization, using a process where hydrogen is not required.

The need for more hydrogen requires the installation of capital intensive hydrogen production units. Therefore, the development of hydrocarbon upgrading processes which provide heteroatom removal and which do not require hydrogen addition (supply) would be highly advantageous and economical. It should be pointed out here that both the FCC (Fluid Catalytic Cracking) process and delayed coking process require no hydrogen supply, but the extent of heteroatom removal and aromatics conversion that are achieved in these two processes are not sufficiently high for the production of the cleaner burning fuels which are required today.

It would represent a very distinct advance in the art if an upgrading process were available which did not require hydrogen and yet provided a way to remove substantial amounts of sulfur, nitrogen, aromatics, and acidic components such as naphthenic acids, while the API gravity of the oil is improved substantially prior to the FCC process, delayed coking, hydrocracking, etc., such that the final product would have levels of sulfur, nitrogen and aromatics which are much lower and closer to the requirements of strict environmental regulations.

SUMMARY OF THE INVENTION

In accordance with certain of its aspects this invention is directed to a catalytic process for upgrading hydrocarbon feedstock containing sulfur compounds, nitrogen compounds, and aromatic compounds to substantially reduce its sulfur, nitrogen and aromatics concentrations and to reduce its specific gravity simultaneously, which comprises:

charging said hydrocarbon feedstock, without any external supply of hydrogen, to a reactor system, and contacting said charge hydrocarbon with a catalyst consisting essentially of a high surface area activated carbon with no intentionally loaded metals at low to moderate pressures and moderate temperatures, and recovering the lower boiling hydrocarbon product having substantially less specific gravity, and having substantially lower concentrations of sulfur, nitrogen, and aromatics.

The process may also be conducted by charging the hydrocarbon feedstock, together with a particulate activated carbon catalyst to a reactor system at low to moderate pressures and moderate temperatures.

Hydrogen could optionally be used in the process to effect additional heteroatom removal, hydrocracking, and other upgrading reactions.

BRIEF DESCRIPTION OF THE DRAWINGS

FIG. 1 shows changes in concentration of sulfur, nitrogen and aromatics over time over an activated carbon catalyst.

FIGS. 2, 3, and 4 show the results of a comparative example conducted under identical conditions, but where the reactor is packed with low surface area alpha alumina.

DETAILED DESCRIPTION OF THE INVENTION

In the present invention it has been discovered that substantial desulfurization, denitrogenation, and aromatics conversion of a hydrocarbon oil is effected under reaction conditions where no external hydrogen is supplied, over a high surface area activated carbon catalyst. In addition, the boiling range of the product hydrocarbon was found to be substantially lower than that of the starting feed hydrocarbon. Though not bound to any theory, this is believed to be possible due to hydrogen transfer between hydrogen donors and acceptors present in the oil, catalyzed by the activated carbon. Literature reports indicate that high surface area activated carbons can be good catalysts for transferring hydrogen from a saturated hydrocarbon to an unsaturated hydrocarbon.

In the present invention, for example, over 70% sulfur removal, nearly 90% nitrogen removal, and a significant 40% aromatics conversion of light atmospheric gas oil (LAGO) containing 0.71% sulfur, 500 ppm (parts per million) nitrogen and 32% aromatics by weight is observed using high surface area activated carbon catalysts, with no metals loaded, in a fixed bed flow reactor system, without any external supply of hydrogen, at a low pressure of 100 psi, at an LHSV (Liquid hourly space velocity) of 2.0 vol/vol and a temperature of 485° C. The initial boiling point (IBP) of the product hydrocarbon oil was substantially lower than that of the feed light gas oil.

Important advantages which can be realized from this invention are:

(a) The process is highly economical, since the process of this invention requires no externally supplied hydrogen for upgrading. In a conventional hydrotreating process for sulfur and nitrogen removal, depending on the feed and reaction conditions, 300–2000 SCF of hydrogen is usually consumed per barrel of feed. The cost of 1000 SCF of hydrogen is between $3.00 and $4.00; therefore, the savings with the present invention is very significant.

(b) The process occurs at relatively low pressure, and, therefore, would be not very expensive to implement.

(c) The activated carbon catalyst is cheap, and is abundant. After use, the catalyst might possibly be regenerated and reused, or might be disposed of by simply burning. It could also be gasified to produce valuable synthesis gas.

Feedstock

The charge hydrocarbons which may be treated by the process of this invention include those which are heavier than kerosene (specific gravity 0.81). These include hydrocarbons commonly designated as heavy oils, heavy and light whole crude oils, atmospheric and vacuum residua, light and heavy gas oils, and middle distillates, as well as crude oil-water emulsions and heavy oil-water emulsions. Coal liquids, sand oils and shale oils, and hydrocarbon fractions derived from these are also suitable feeds for the process of the present invention.

An additional advantage which would be anticipated when an emulsion of hydrocarbon with water is used as a feed in the present process is the possibility of in situ generation of hydrogen by the reaction of water with the activated carbon at high reaction temperatures. Part of the hydrogen can be recovered and part might actually react in the process to effect additional heteroatom removal, hydrocracking, and other upgrading reactions.

A typical charge which may be treated is a light atmospheric gas oil (LAGO) having the composition given in Table 1. It should be mentioned that even though LAGO was used in the examples presented here to demonstrate the novelty of the process, the process of the invention is applicable for processing a variety of petroleum fractions, as described earlier.

TABLE 1

| Properties of LAGO | |
|---|---|
| API Gravity | 32° |
| IBP | 197° C. |
| 10% | 263° C. |
| 50% | 299° C. |
| 90% | 344° C. |
| FBP | 360° C. |
| S, wt. % | 0.71 |
| N, ppm wt. | 500 |
| Aromatics (wt %) (SFC) | 32 |

In the practice of the process of this invention, the process conditions include fairly low pressures and moderate temperatures. The charge may be admitted to the catalyst bed at about 300°–650° C., preferably 350°–550° C., say about 410°–485° C., depending on the charge. Heavier charges tend to react generally at lower temperatures. The range for pressure is atmospheric to about 1000 psi, preferably 50–200 psi, say about 100 psi. No gas, and particularly no hydrogen is required. However, an inert gas or mixture of inert gases can be used at 10–1000 SCFB. Optionally, hydrogen can be used at a rate of 100–5000 SCFB. LHSV based on catalyst volume may be 0.1–5.0, preferably 0.5–3.0, say 2 in the case of fixed bed reactor system.

Though the activated carbon catalyst exhibited significant deactivation in about 5 hours, the process of the invention could be effected in a fixed bed reactor system with periodic regeneration. An ebullated bed reactor, fluidized bed reactor and slurry flow reactor could also be used. The present invention can be employed in several different processes for upgrading hydrocarbon fluids. Examples include (a) fluidized bed reactor operation resembling the FCCU, where a slurry of the hydrocarbon feed with activated carbon is reacted in a fluidized bed, (b) an ebullated or moving bed reactor operation where the spent activated carbon catalyst is continuously removed and fresh activated carbon is continuously added, (c) a simple visbreaker-like process where a slurry of activated carbon with the hydrocarbon feed is sent through a heated tubular reactor, and (d) a delayed coker-like process where the activated carbon-hydrocarbon feed slurry is allowed to react in a batch or semi-continuous process. Other similar processes for significantly upgrading hydrocarbon feeds can be visualized by those experienced in the art, based on the present invention.

The catalyst is an activated carbon having a high surface area. All carbon materials with B.E.T. surface areas greater than 200 $m^2/g$, derived from any raw material such as coal, wood, peat, lignite, coconut shell, olive pits, synthetic polymers, coke, petroleum pitch, coal tar pitch, etc. are suitable as catalysts for the present invention.

The Total Surface Area (Brunauer-Emmett-Teller, BET) of the carbon material should be at least about 200 $m^2/g$ and typically between 200 $m^2/g$ and 2000 $m^2/g$. The preferred range is between 600 $m^2/g$ and 1600 $m^2/g$. The Total Pore Volume (TPV) for nitrogen is at least about 0.3 cc/g, preferably above 0.5 cc/g, say 0.8 cc/g. In the case of activated carbon catalysts, the Average Pore Diameter by nitrogen physisorption is in the range of 12–100 Angstroms, preferably 16–50 Angstroms, say 30 Angstroms. Preferably 20–80% of the Total Pore Volume of the carbon support should exist in pores in the mesopore range (20–500 Angstroms diameter).

The physical form of the catalyst can take any number of shapes and sizes, such as, for example, powder, pellets, spheres, etc. The carbon materials may also contain one or more refractory oxides as minor components, generally termed as ash, the total of these being less than about 20 wt %. Carbon blacks are especially preferred when the carbon catalyst is dispersed in the oil and fed into a reactor for the process of the present invention.

It is not necessary to incorporate any additives or promoters on the activated carbon, although the activated carbon catalyst will also work with a metal compound or a mixture of metal compounds deposited thereon.

Chemical additives such as those used in the industry for inhibiting coking reactions may also be used in the process.

To illustrate the process of the invention the following Examples are given. It is understood, however, that the Examples are given only in the way of illustration and are not to be regarded as limiting the invention in any way.

EXPERIMENTAL PROCEDURE 20 cc of the catalyst was loaded into the center of a stainless steel reactor of 19 mm ID and 40 cm long. The rest of the reactor was packed with 12×48 particles of very low surface area alpha alumina. After attaching the reactor to the catalyst screening unit, the catalyst bed temperature was programmed to increase to 485° C. in 90 minutes and stay constant thereafter. The temperature program was started and, at the same time, the liquid feed pump was started at 40 cc/hour. At this flow rate, it takes approximately 90 minutes for the liquid feed to fill in all the feed tubes and the reactor, and be seen at the outlet of the reactor. The time when the catalyst bed reached the reaction temperature was taken as the starting time of our reaction. The total pressure in the reactor was adjusted to approximately 100 psig.

Liquid product samples were collected at various reaction times on stream, and were sparged with hydrogen gas to remove the dissolved $H_2S$ and $NH_3$ gases before they were analyzed for their sulfur, nitrogen and aromatics contents. The S and N concentrations of the feed and product samples were determined by X-ray fluorescence (XRF), ASTM D2622, and Chemiluminescence techniques respectively. The weight % aromatics in the feed as well as in the product samples were measured by Supercritical Fluid Chromatography, ASTM D5186. The extent of sulfur removal, nitrogen removal, and aromatics conversion were calculated from these analyses. The product samples were analyzed by mass spectrometry (ASTM D2425) for hydrocarbon type analysis. They were also analyzed by GC simulated distillation (ASTM D2887) to find out if the boiling range of the hydrocarbon feed has been changed due to the reaction.

The liquid feed used for all the experiments presented here was a light atmospheric gas oil (LAGO) having the properties and composition given in Table 1, supra. It should be mentioned here that even though LAGO was used as the feed in the examples presented here, the process of the present invention is applicable for processing various oils and petroleum fractions as described above.

EXAMPLE (INVENTION)

20 cc of a commercially available activated carbon known by the brand name, Nuchar BX-7530 carbon obtained from the Westvaco Company in the form of 20×40 mesh particles was used as the catalyst in this example. It has a Brunauer-Emmett-Teller (BET) surface area of 1128 $m^2/g$, a nitrogen pore volume (TPV) of 0.82 cc/g, and an average Pore diameter estimated using the Wheeler equation of 29.2 Angstroms calculated from nitrogen physisorption data, an apparent bulk density of 0.37 g/cc and an ash content of less than 7 wt %.

The catalyst bed temperature was programmed to increase to 485° C. in 90 minutes and stay constant thereafter. The temperature program was started and, at the same time, the liquid feed pump was started at 40 cc/hour. The reactor pressure was adjusted to 100 psig. The time when the catalyst bed reached the reaction temperature was taken as the start of the reaction.

Results are shown in Figure S-1. The changes in the sulfur, nitrogen, and aromatics concentrations of the product with reaction time are presented in Fig. S-1. Data presented in Fig. S-1 indicate that the activated carbon catalyst was extremely active in the beginning, effecting significant sulfur and nitrogen removal and conversion of aromatics. It is noted, however, that the sulfur, nitrogen and aromatics conversions fell with time, indicating that the catalyst deactivated. Strangely, after several hours on stream, the product contained slightly more nitrogen and aromatics than the feed, but always less sulfur. After running overnight and cooling down, the reactor tube after the catalyst bed was found to be coked.

Simulated distillation results indicate that the product samples were significantly lighter than the feed LAGO. "Recovery" at 700° F. increased up to as much as 98% for some of the products, compared to only 90.2% for the LAGO feed. The initial boiling point (IBP) was also lowered due to this upgrading reaction. LAGO feed has an IBP of 250° F. One of the product samples had an IBP of only 188° F., indicating substantial lightening of the light gas oil in this reaction.

Results from the mass spectroscopic analyses indicate that substantial portions of naphthalenes, biphenyl, and higher multinuclear aromatics in the feed were converted in the reaction. Alkyl benzenes, however, were not affected significantly. Significant increases were seen in the concentration of all types of paraffins due to the upgrading reaction.

COMPARATIVE EXAMPLE I

In order to rule out the possibility of the empty stainless steel reactor tube (possibly with the sulfide coating inside) and/or the inert alpha alumina particles acting as a catalyst for the unexpected results presented in the above invention example, a blank experiment was conducted with the reactor packed with alpha alumina particles instead of the activated carbon. The blank experiment was conducted under identical conditions, without the activated carbon catalyst. The entire reactor was packed in this case with highly inert, extremely low surface area alpha alumina (20×48 mesh particles). Results of this comparative example also help us to prove that the activated carbon does indeed act as a catalyst in this reaction.

Results of this blank experiment are shown in FIGS. 2, 3, and 4. Also shown in these figures are the results obtained with the activated carbon catalyst for comparison. The following can be deduced from these figures:

(i) Substantial desulfurization took place without the activated carbon catalyst, possibly due to thermal reaction, but the % desulfurization in this case was significantly lower than that with the activated carbon catalyst.

(ii) Denitrogenation was negligible without the activated carbon catalyst. It should be noted that with the activated carbon catalyst we observed almost 90% denitrogenation in the first hour of the reaction.

(iii) Aromatics conversion was also negligible without the activated carbon catalyst. We observed almost 40% aromatics conversion with the activated carbon catalyst in the first hour of the reaction.

Changes in the boiling ranges of the product samples unobserved in this experiment with alpha alumina were significantly less when compared to the changes observed in the experiment with activated carbon catalyst. Small reduction in the IBP were noticed, which most probably were due to the thermal effects.

These observations clearly demonstrate that the activated carbon acts as a catalyst to effect this substantial heteroatom removal and aromatics conversion.

COMPARATIVE EXAMPLE II

To rule out the possibility that the activated carbon might be just physically adsorbing and removing the sulfur and nitrogen compounds and aromatics, we conducted an experiment wherein we stirred 20 cc of the BX-7530 activated carbon with 80 cc of LAGO at room temperature for about 3 hours. The filtered liquid contained 9% less sulfur, about 25% less nitrogen, and about 5% less aromatics than the starting LAGO. If the physical adsorption is so little at room temperature, it should be negligible at the reaction temperature of 485° C. Absolutely no change in the boiling characteristics of the gas oil was observed. Therefore, we can rule out the possibility that the activated carbon is causing the heteroatom removal and aromatics removal by just physically adsorbing them.

Separation System, Inc. File Name: 408Z021—Apr. 11, 1994

SimDis Expert V 3.0 Sample ID N000452001/LAGO

Boiling Point Distribution Table

Test:ASTM D-2887

Sample: Feed Light Atmospheric Gas Oil

| % Off | BP (F) | BP (C) |
|---|---|---|
| IBP | 250 | 121 |
| 5 | 411 | 210 |
| 10 | 461 | 238 |
| 15 | 488 | 254 |
| 20 | 510 | 266 |
| 25 | 524 | 273 |
| 30 | 536 | 280 |
| 35 | 546 | 285 |
| 40 | 558 | 292 |
| 45 | 571 | 300 |
| 50 | 582 | 305 |
| 55 | 596 | 313 |
| 60 | 608 | 320 |
| 65 | 621 | 327 |
| 70 | 634 | 335 |
| 75 | 649 | 343 |
| 80 | 663 | 351 |
| 85 | 680 | 360 |
| 90 | 698 | 370 |
| 95 | 720 | 382 |
| FBP | 783 | 417 |

Reaction with Activated Carbon Catalyst—Example of Invention

Product sample Cut #2—Time on Stream=2 hours

Separation Systems, Inc. File Name: 408Z024—Apr. 11, 1994

SimDis Expert V 3.0 Sample ID N000451401/CSU2-244-2

| Boiling Point Distribution Table ASTM D-2887 | | |
|---|---|---|
| % Off | BP (F) | BP (C) |
| IBP | 188 | 87 |
| 5 | 291 | 144 |
| 10 | 356 | 180 |
| 15 | 401 | 205 |
| 20 | 428 | 220 |
| 25 | 456 | 236 |
| 30 | 477 | 247 |
| 35 | 497 | 258 |
| 40 | 514 | 268 |
| 45 | 526 | 274 |
| 50 | 537 | 280 |
| 55 | 547 | 286 |
| 60 | 560 | 293 |
| 65 | 574 | 301 |
| 70 | 586 | 308 |
| 75 | 602 | 317 |
| 80 | 617 | 325 |
| 85 | 636 | 335 |
| 90 | 659 | 349 |
| 95 | 691 | 366 |
| FBP | 756 | 402 |

Reaction w/Alpha-Alumina in Reactor

COMPARATIVE EXAMPLE I

Product sample Cut #1: Time on Stream=2 hours

Separation System, Inc. File Name: 408Z024—Apr. 11, 1994

SimDis Expert V 3.0 Sample ID N000451401/CSU2-244-2

| Boiling Point Distribution Table ASTM D-2887 | | |
|---|---|---|
| % Off | BP (F) | BP (C) |
| IBP | 250 | 121 |
| 5 | 375 | 191 |
| 10 | 423 | 217 |
| 15 | 459 | 237 |
| 20 | 483 | 250 |
| 25 | 504 | 262 |
| 30 | 520 | 271 |
| 35 | 531 | 277 |
| 40 | 541 | 283 |
| 45 | 551 | 289 |
| 50 | 564 | 296 |
| 55 | 577 | 303 |
| 60 | 588 | 309 |
| 65 | 602 | 317 |
| 70 | 614 | 323 |
| 75 | 629 | 331 |
| 80 | 643 | 340 |
| 85 | 660 | 349 |
| 90 | 680 | 360 |
| 95 | 707 | 375 |
| FBP | 802 | 428 |

Reaction w/ Alpha -Alumina in Reactor

COMPARATIVE EXAMPLE I

Product sample Cut #2, time on stream=3 hours

Separation System, Inc. File Name: 420Z005A—Apr. 21, 1994

SimDis Expert V 3.0 Sample ID N000511201/2-297 C2

| Boiling Point Distribution Table ASTM D-2887 | | |
|---|---|---|
| % Off | BP (F) | BP (C) |
| IBP | 226 | 108 |
| 5 | 333 | 167 |
| 15 | 427 | 220 |
| 20 | 458 | 237 |
| 25 | 481 | 249 |
| 30 | 501 | 261 |
| 35 | 518 | 270 |
| 40 | 528 | 276 |
| 45 | 539 | 282 |
| 50 | 549 | 287 |
| 55 | 562 | 294 |
| 60 | 575 | 302 |
| 65 | 585 | 307 |
| 70 | 600 | 315 |
| 75 | 612 | 322 |
| 80 | 627 | 331 |
| 85 | 644 | 340 |
| 90 | 662 | 350 |
| 95 | 689 | 365 |
| FBP | 776 | 414 |

Test D2425—Hydrocarbon Type Analysis of Middle Distillates by Mass Spectrometry

LIMS Reference: N0001743 Version 1

Sample Number: LAGO Feed

| Hydrocarbon Type | wt % |
|---|---|
| Paraffins | 30.4 |
| Monocycloparaffins | 17.7 |
| Dicycloparaffins | 12.9 |
| Tricycloparaffins | 5.8 |
| Total Saturates | 66.8 |
| Alkylbenzenes | 8.1 |
| Indanes/Tetralins | 5.2 |
| Dinaphthenebenzenes/Indenes | 3.8 |
| Naphthalenes | 7.2 |
| Biphenyl/Acenaphthenes | 4.3 |
| Fluorenes/Acenaphthylenes | 2.9 |
| Phenanthrenes | 1.9 |
| Total Aromatics | 33.4 |
| Total | 100.2 |
| Aromatic Overlap | 1.2 |
| Saturate Overlap | 0.8 |
| OC Recovery | 98.8 |

EXAMPLE (INVENTION): ACTIVATED CARBON CATALYST

Product sample—TIME ON STREAM=2 Hours

Test D2425—Hydrocarbon Type Analysis of Middle Distillates by Mass Spectrometry

LIMS Reference: N0001745 Version 01

Sample Number: CSU2-244-2

| Hydrocarbon Type | Wt % |
|---|---|
| Paraffins | 32.5 |
| Monocycloparaffins | 21.3 |
| Dicycloparaffins | 13.3 |
| Tricycloparaffins | 5.3 |
| Total Saturates | 71.4 |
| Alkylbenzenes | 9.5 |

-continued

| Hydrocarbon Type | Wt % |
|---|---|
| Indanes/Tetralins | 5.6 |
| Dinaphthenebenzenes/Indenes | 3.2 |
| Naphthalenes | 5.6 |
| Biphenyl/Acenaphthenes | 2.4 |
| Fluorenes/Acenaphthylenes | 1.6 |
| Phenanthrenes | 0.6 |
| Total Aromatics | 28.5 |
| Total | 99.9 |
| Aromatic Overlap | 1.8 |
| Saturate Overlap | 0.8 |
| OC Recovery | 99.1 |

EXAMPLE (INVENTION): ACTIVATED CARBON CATALYST

Product at TIME ON STREAM=1 HOUR

Test D2425—Hydrocarbon Type Analysis of Middle Distillates by Mass Spectrometry

LIMS Reference: N0001744

Sample Number: CSU2-244-1

| Hydrocarbon Type | Wt % |
|---|---|
| Paraffins | 34.2 |
| Monocycloparaffins | 22.7 |
| Dicycloparaffins | 15.3 |
| Tricycloparaffins | 6.6 |
| Total Saturates | 78.8 |
| Alkylbenzenes | 7.3 |
| Indanes/Tetralins | 5.0 |
| Dinaphthenebenzenes/Indenes | 3.0 |
| Naphthalenes | 3.0 |
| Biphenyl/Acenaphthenes | 1.5 |
| Fluorenes/Acenaphthylenes | 0.9 |
| Phenanthrenes | 0.4 |
| Total Aromatics | 21.1 |
| Total | 99.9 |
| Aromatic Overlap | 1.9 |
| Saturate Overlap | 0.4 |
| OC Recovery | 98.9 |

COMPARATIVE EXAMPLE I

Product sample at Time on Stream=2 Hours

TEST D2425—Hydrocarbon Type Analysis of Middle Distillates by Mass Spectrometry

LIMS Reference: N0005111 Version 01

Sample Number: CSU1-297 CUT 1

| Hydrocarbon Type | Wt % |
|---|---|
| Paraffins | 27.9 |
| Monocycloparaffins | 18.3 |
| Dicycloparaffins | 11.9 |
| Tricycloparaffins | 5.6 |
| Total Saturates | 63.7 |
| Alkylbenzenes | 9.3 |
| Indanes/Tetralins | 6.7 |
| Dinaphthenebenzenes/Indenes | 4.5 |
| Naphthalenes | 6.7 |
| Biphenyl/Acenaphthenes | 4.2 |
| Fluorenes/Acenaphthylenes | 3.0 |
| Phenanthrenes | 1.8 |

-continued

| Hydrocarbon Type | Wt % |
|---|---|
| Total Aromatics | 36.2 |
| Total | 99.9 |
| Aromatic Overlap | 1.5 |
| Saturate Overlap | 1.0 |
| OC Recovery | 98.4 |

COMPARATIVE EXAMPLE I

Product sample at Time on Stream=3 Hours

TEST D2425—Hydrocarbon Type Analysis of Middle Distillates by Mass Spectrometry

LIMS Reference: N0005112 Version 01

Sample Number: CSU1-297 CUT 2

| Hydrocarbon Type | Wt % |
|---|---|
| Paraffins | 26.8 |
| Monocycloparaffins | 20.4 |
| Dicycloparaffins | 11.0 |
| Tricycloparaffins | 5.4 |
| Total Saturates | 63.6 |
| Alkylbenzenes | 9.1 |
| Indanes/Tetralins | 5.4 |
| Dinaphthenebenzenes/Indenes | 4.4 |
| Naphthalenes | 7.6 |
| Biphenyl/Acenaphthenes | 4.5 |
| Fluorenes/Acenaphthylenes | 3.3 |
| Phenanthrenes | 2.0 |
| Total Aromatics | 36.3 |
| Total | 99.9 |
| Aromatic Overlap | 1.7 |
| Saturate Overlap | 1.3 |
| OC Recovery | 100.0 |

Although our invention has been described in terms of a series of specific preferred embodiments and illustrative examples which applicants believe to include the best mode for applying their invention known to them at the time of this application, it will be recognized to those skilled in the art that various modifications can be made to the process described herein without departing from the spirit and scope of our invention which is defined more precisely in the claims appended hereinafter below:

We claim:

1. A process for upgrading a hydrocarbon feed stock containing sulfur compounds, nitrogen compounds, and aromatic compounds to reduce the sulfur, nitrogen, and aromatics contents, thereof and to simultaneously lower the specific gravity thereof which comprises:

contacting said hydrocarbon feedstock, without any external supply of hydrogen or water at a temperature of about 300° to about 650° C. and a pressure of about atmospheric to −1000 psia, with a catalyst wherein the said catalyst consists essentially of activated carbon and recovering the lighter product hydrocarbon containing reduced concentrations of sulfur, nitrogen, and aromatics.

2. The process of claim 1 wherein the hydrocarbon feedstock is selected from the group consisting of middle distillates, gas oils, residua, crude oils, heavy crude oils, coal liquifaction liquids, shale oils, sand oils, crude oil - water emulsions, and heavy oil - water emulsions.

3. The process of claim 1 wherein the process is effected in a reactor system selected from the group consisting of fixed bed, slurry flow through reactor, ebullated bed, fluidized bed, and moving bed reactor systems, and delayed coker system.

4. The process of claim 1 wherein the temperature is in the range of 400°–450° C.

5. The process of claim 1 wherein the pressure is in the range of 50–200 psig.

6. The process of claim 1 wherein the activated carbon catalyst is prepared from the group consisting of coal, peat, lignite, wood, coke and hydrocarbons.

7. The process of claim 1 wherein the form of the catalyst is selected from the group consisting of powders, pellets, extrudates, fibers, granules and spheres.

8. The process of claim 1 wherein the activated carbon catalyst is a carbon black.

9. The process of claim 1 wherein the activated carbon catalyst has a B.E.T. surface area of greater than 200 $m^2/g$.

10. The process of claim 1 wherein the concentration of catalyst in the feed is 0.1–10 wt % of the feed when the process is conducted in a slurry flow reactor system.

11. The process of claim 1 wherein the liquid hourly space velocity (LHSV) for a fixed bed reactor system is 0.1–5.0.

12. The process of claim 1 wherein no gas is supplied for the process.

* * * * *